US011048211B2

(12) United States Patent
Kojima

(10) Patent No.: US 11,048,211 B2
(45) Date of Patent: Jun. 29, 2021

(54) WATCH AND WATCH FACE THEREOF

(71) Applicant: KABUSHIKI KAISHA PRODIA, Kiryuu (JP)

(72) Inventor: Yoshiyasu Kojima, Kiryuu (JP)

(73) Assignee: KABUSHIKI KAISHA PRODIA, Kiryuu (JP)

( * ) Notice: Subject to any disclaimer, the term of this patent is extended or adjusted under 35 U.S.C. 154(b) by 52 days.

(21) Appl. No.: 16/301,712

(22) PCT Filed: Jun. 8, 2018

(86) PCT No.: PCT/JP2018/022039
§ 371 (c)(1),
(2) Date: Nov. 14, 2018

(87) PCT Pub. No.: WO2018/235635
PCT Pub. Date: Dec. 27, 2018

(65) Prior Publication Data

US 2020/0379410 A1 Dec. 3, 2020

(30) Foreign Application Priority Data

Jun. 20, 2017 (JP) ..... JP2017-120657

(51) Int. Cl.
*G04B 45/00* (2006.01)
*G04B 19/04* (2006.01)
*G04B 19/14* (2006.01)

(52) U.S. Cl.
CPC ..... *G04B 45/0092* (2013.01); *G04B 19/044* (2013.01); *G04B 19/14* (2013.01)

(58) Field of Classification Search
CPC ... G04B 19/044; G04B 19/14; G04B 45/0092
See application file for complete search history.

(56) References Cited

U.S. PATENT DOCUMENTS 4,660,992 A * 4/1987 Paul ..... G04B 45/0092 368/223
5,008,869 A * 4/1991 Dweck ..... G04B 37/127 368/228

(Continued)

FOREIGN PATENT DOCUMENTS

CH 501258 A 9/1970
CN 2657053 Y 11/2004

(Continued)

OTHER PUBLICATIONS

An Office Action issued by the China National Intellectual Property Administration dated Oct. 27, 2020, which corresponds to Chinese Patent Application No. 201880002066.0 and is related to U.S. Appl. No. 16/301,712 with English language translation.

(Continued)

*Primary Examiner* — Edwin A. Leon
*Assistant Examiner* — Jason M Collins
(74) *Attorney, Agent, or Firm* — Studebaker & Brackett PC

(57) ABSTRACT

A watch includes a watch body, a watch face attached to the watch body and having an opening, and a pointer. The pointer includes an extension portion disposed to sandwich the watch face between the extension portion and the watch body and extending from the opening to face an upper surface of the watch face, and a support portion protruding from the watch body into the upper surface of the watch face via the opening, and connected directly to the extension portion. The pointer includes a change portion formed in the extension portion to change a posture of the extension portion such that a front end of the extension portion is raised with respect to a base end of the extension portion to be apart from the watch face. The watch face is removed (Continued)

from the watch body along the extension portion raised by the change portion.

7 Claims, 9 Drawing Sheets

(56) References Cited

U.S. PATENT DOCUMENTS

| | | | | |
|---|---|---|---|---|
| 5,018,118 | A * | 5/1991 | Ross | G04B 19/02 368/223 |
| 5,793,710 | A * | 8/1998 | Jacobi, Jr. | G04B 45/0092 368/223 |
| 8,879,368 | B2 * | 11/2014 | Jacobi, Jr. | G04B 45/0092 368/232 |
| 2004/0228221 | A1 | 11/2004 | Wolf et al. | |
| 2011/0019507 | A1 | 1/2011 | Muraji | |

FOREIGN PATENT DOCUMENTS

| | | | |
|---|---|---|---|
| CN | 201237702 | Y | 5/2009 |
| CN | 202067085 | U | 12/2011 |
| CN | 204086824 | U | 1/2015 |
| CN | 205247079 | U | 5/2016 |
| CN | 205384448 | U | 7/2016 |
| CN | 106125534 | A | 11/2016 |
| CN | 106855687 | A | 6/2017 |
| EP | 1395882 | A1 | 3/2004 |
| JP | S55-179383 | U | 12/1980 |
| JP | H07-280956 | A | 10/1995 |
| JP | 3065535 | U | 2/2000 |
| NL | 1011340 | C2 | 8/2000 |

OTHER PUBLICATIONS

The extended European search report issued by the European Patent Office dated Oct. 21, 2019, which corresponds to EP18796817.7-1003 and is related to U.S. Appl. No. 16/301,712.

International Search Report and Written Opinion issued in PCT/JP2018/022039; dated Jul. 3, 2018.

An Office Action mailed by the State Intellectual Property Office of the Peoples Republic of China dated Apr. 1, 2020, which corresponds to Chinese Patent Application No. 201880002066.0 and is related to U.S. Appl. No. 16/301,712 with English language translation.

* cited by examiner

WATCH AND WATCH FACE THEREOF

TECHNICAL FIELD

The present invention relates to a watch and a watch face, more specifically to a watch including a watch body to which a watch face and pointers are attached.

BACKGROUND ART

A watch including a watch body to which a watch face and pointers are attached has been used from conventional. In general, the watch face of the watch is disposed between the pointers and the watch body. Accordingly, when the watch face is removed from the watch body, the pointers need to be removed together, and therefore it is troublesome to change the watch face.

As a technique to make it easy to replace the watch face, a watch device having a watch face capable of being replaced depending on people's taste to provide a variety of visual expressions has been proposed as in Patent Literature 1. In this watch device having the watch face capable of being replaced, a cut portion is formed in one side of the watch face, and a fitting plate is fitted in the concave portion. When the watch face is inserted into a storage space from the opening of a casing, the fitting plate is fitted in the concave portion, and therefore it is possible to make it easy to replace the watch face.

CITATION LIST

Patent Literature

PTL1: Japanese Utility Model Registration No. 3065535

SUMMARY OF INVENTION

Technical Problem

However, the watch device having the watch face capable of being replaced disclosed in PTL 1 has a problem with the concave portion formed in the watch face which may impair the function of the watch face, for example, the legibility of the time and the design.

The present invention has been achieved to solve the above-described problem. It is therefore an object of the present invention to provide a watch having a watch face capable of being easily removed while maintaining the function of the watch face.

Solution to Problem

According to an aspect of the invention, a watch includes a watch body, a watch face attached to the watch body and having an opening, and a pointer. The pointer includes an extension portion disposed to sandwich the watch face between the extension portion and the watch body and extending from the opening to face an upper surface of the watch face, and a support portion protruding from the watch body into the upper surface of the watch face via the opening, and connected directly to the extension portion. The pointer includes a change portion formed in the extension portion to change a posture of the extension portion such that a front end of the extension portion is raised with respect to a base end of the extension portion to be apart from the watch face. The watch face is removed from the watch body along the extension portion raised by the change portion.

The change portion may include a turning member to turn the extension portion to be raised.

The change portion may change the posture of the extension portion to be orthogonal to the watch face.

The watch may include a plurality of pointers each including the extension portion having the change portion. The change portion may change postures of extension portions of the plurality of pointers around the opening at different positions.

The watch face may include a fixing portion to fix the watch face to the watch body.

The watch body may include an ejector configured to lift the watch face to separate the watch face from the watch body.

The watch face may be attached to the above-described watch.

According to the present invention, the pointer includes the change portion to change the posture of the extension portion to be raised, and the watch face is removed from the watch body along the extension portion raised by the change part. By this means, it is possible to provide a watch having a watch face capable of being easily removed while maintaining the function of the watch face.

DESCRIPTION OF EMBODIMENTS

Hereinafter, the embodiments of the present invention will be described with reference to the drawings.

Embodiment 1

Figure 1:
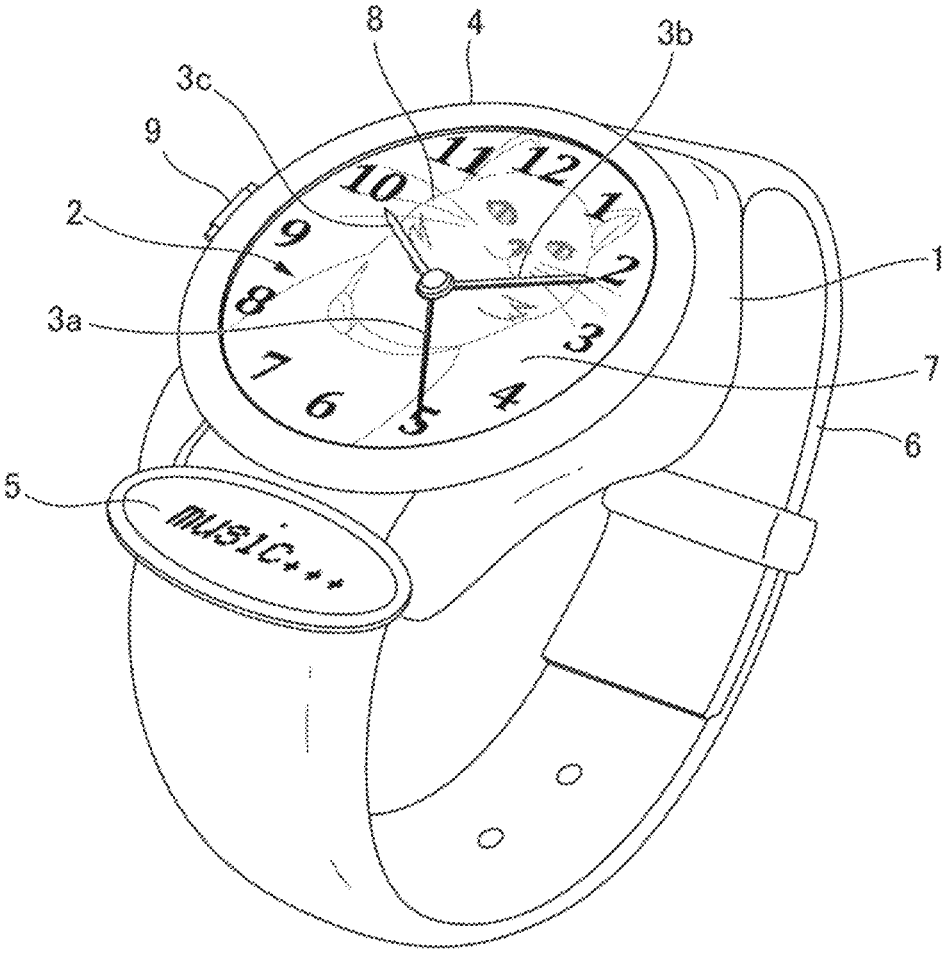
FIG. 1 illustrates the configuration of a watch according to Embodiment 1 of the present invention.

FIG. 1 illustrates the configuration of a watch according to Embodiment 1 of the present invention. This watch is a wristwatch worn on a wrist, and includes a watch body 1. A watch face 2, three pointers 3*a* to 3*c*, a protection member 4, a display 5, and a belt 6 are attached to the watch body 1.

The watch body 1 is configured to support each part such as the watch face 2, and has a shape extending along the wrist. The watch body 1 may be made of a material with a high rigidity, for example, metal. In addition, the watch body 1 includes an information input unit (not shown) used to input, for example, music information and output music by wireless. The watch face 2 has a discoid shape and is attached to the watch body 1. A decoration 8 is displayed on an upper surface 7 of the watch face 2 together with the time.

The pointers 3*a* to 3*c* indicate the time displayed on the upper surface 7 of the watch face 2, and are provided to rotate in the plane parallel to the watch face 2. The pointer 3*a* is a second hand indicating the second on the watch face 2. The pointer 3*b* is a minute hand indicating the minute on the watch face 2. The pointer 3*c* is an hour hand indicating the hour on the watch face 2. The protection member 4 is configured to protect the watch face 2, and provided to cover the watch face 2. An open and close member 9 is provided on the edge of the protection member 4. This open and close member 9 opens and closes the protection member 4 so as to rotate the protection member 4.

The display 5 is configured to display information to the outside, which may be a liquid crystal monitor. The display 5 may be connected to, for example, the information input unit of the watch body 1, and display music information such as the title of a song inputted to the information input unit. The belt 6 is attached to a pair of opposite edges of the watch body 1 and worn around the wrist to fix the watch body 1 to the wrist.

Figure 2:
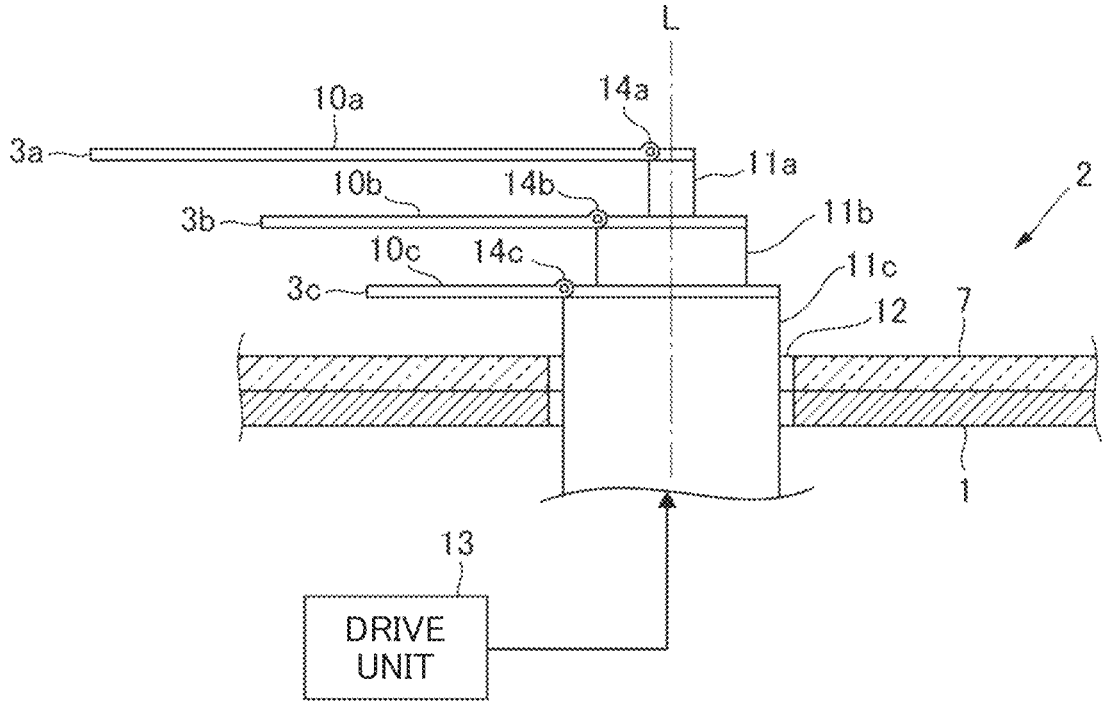
FIG. 2 is a cross-sectional view illustrating the configuration of pointers.

Next, the configuration of the pointers 3*a* to 3*c* will be described. As illustrated in FIG. 2, the pointers 3*a* to 3*c* include extension portions 10*a* to 10*c*, and support portions 11*a* to 11*c*, respectively. The extension portions 10*a* to 10*c* are provided to sandwich the watch face 2 between the extension portions 10*a* to 10*c* and the watch body 1. Here, an opening 12 is formed near the center of the watch face 2. The extension portions 10*a* to 10*c* extend from the opening 12 toward the edge of the watch face 2 parallel to the upper surface 7 of the watch face 2. In this case, the extension portions 10*a* to 10*c* are disposed at different positions apart from each other in a direction orthogonal to the watch face 2, and are spaced from the watch face 2 in order of the extension portions 10*a*, 10*b*, and 10*c*.

The support portions 11*a* to 11*c* are provided to protrude from the watch body 1 into the upper surface 7 of the watch face 2 via the opening 12, and front ends of the support portions 11*a* to 11*c* are connected to the extension portions 10*a* to 10*c*, respectively. To be more specific, the support portion 11*a* at the top is connected to the extension portion 10*a*; the support portion 11*b* protruding between the support portion 11*a* and the support portion 11*c* is connected to the extension portion 10*b*; and the support portion 11*c* at the bottom is connected to the extension portion 10*c*. These support portions 11*a* to 11*c* are attached to the watch body 1 to rotate about a rotation center L as an axis extending orthogonal to the watch face 2. The support portions 11*a* to 11*c* are rotated by a drive unit 13 provided in the watch body 1 according to the progression of time.

The pointers 3*a* to 3*c* include turning members 14*a* to 14*c* configured to turn the extension portions 10*a* to 10*c* to be raised to change the postures of the extension portions 10*a* to 10*c*, respectively. These turning members 14*a* to 14*c* are disposed near the base ends of the extension portions 10*a* to 10*c*.

Figure 3:
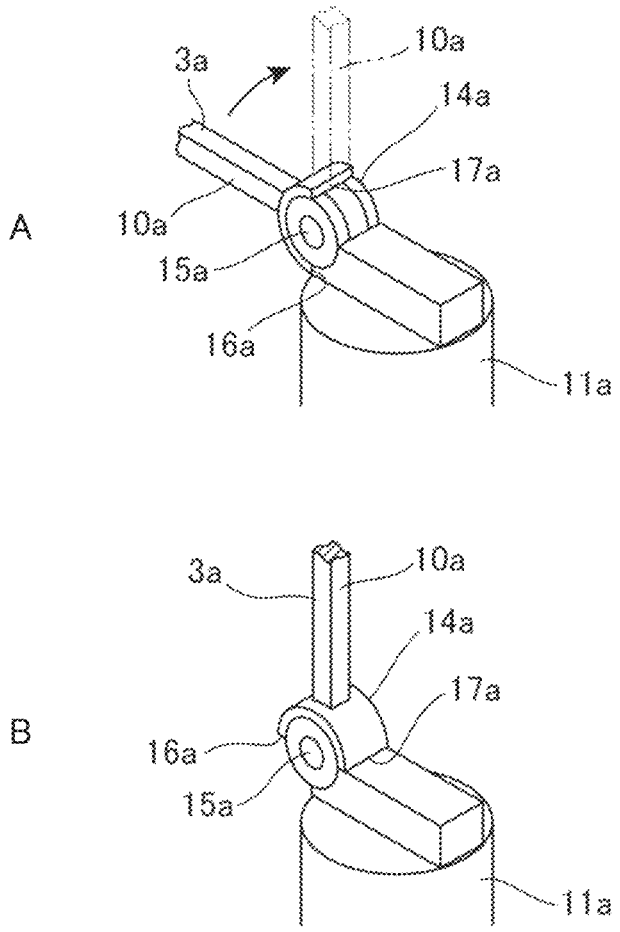
FIG. 3 illustrates a state where an extension portion is turned by a turning member.

As illustrated in FIG. 3A, the turning member 14*a* is disposed near the base end of the extension portion 10*a* to turn the extension portion 10*a* to be raised from the upper surface 7 of the watch face 2. The turning member 14*a* includes a turning shaft 15*a*, an end portion 16*a*, and an end portion 17*a*. The turning shaft 15*a* serves as the axis of turning of the extension portion 10*a* and extends in a direction orthogonal to the extension portion 10*a*.

The end portion 16*a* contacts the extension portion 10*a* in the vicinity of the base end of the extension portion 10*a* in order to maintain the posture of the extension portion 10*a* extending parallel to the watch face 2. The end portion 16*a* is formed on the lower surface side of the extension portion 10*a*. Meanwhile, as illustrated in FIG. 3B, when the extension portions 10*a* is tuned 90 degrees, the end portion 17*a* abuts on the extension portion 10*a* in the vicinity of the base end of the extension portion 10*a* to maintain the posture of the extension portion 10*a*. The end portion 17*a* is formed on the upper surface side of the extension portion 10*a*. As described above, the extension portion 10*a* is turned about the turning shaft 15*a* in a direction approximately orthogonal to the watch face 2 to maintain the posture of the extension portion 10*a* by the end portion 17*a*. Here, the configuration of the turning members 14*b* and 14*c* is approximately the same as that of the turning member 14*a*.

Here, as illustrated in FIG. 2, the turning members 14*a* to 14*c* are located inside the opening 12 in a direction along the watch face 2. Therefore, when the extension portions 10*a* to 10*c* are raised by the turning members 14*a* to 14*c* and therefore are orthogonal to the upper surface 7 of the watch face 2, the extension portions 10*a* to 10*c* are located within the opening 12 in the direction along the watch face 2. That is, the extension portions 10*a* to 10*c* are raised to extend in the opening direction of the opening 12. Then, the opening 12 is moved along the extension portions 10*a* to 10*c* raised by the turning members 14*a* to 14*c*, so that the watch face 2 is removed from the watch body 1.

Next, the operation according to Embodiment 1 will be described. First, as illustrated in FIG. 1, the watch face 2 on which the decoration 8 is displayed is attached to the watch body 1. In this case, as illustrated in FIG. 2, the pointers 3*a* to 3*c* are rotated on the upper surface 7 of the watch face 2 by the drive unit 13 to indicate the time displayed on the watch face 2.

Next, the drive unit 13 is stopped by pushing, for example, a stop switch (not shown) to stop the rotation of the pointers 3*a* to 3*c*. Then, the protection member 4 covering the pointers 3*a* to 3*c* is pushed up by the hand to separate the protection member 4 from the watch body 1, and opened by the rotation of the open and close member 9 to a position where the protection member 4 does not overlap the watch face 2.

When the protection member 4 is opened, the front ends of the pointers 3*a* to 3*c* are pushed up by the hand such that the pointers 3*a* to 3*c* are apart from the watch face 2. Then, the extension portions 10*a* to 10*c* of the pointers 3*a* to 3*c* are turned by the turning members 14*a* to 14*c* to change the postures of the extension portions 10*a* to 10*c* such that the extension portions 10*a* to 10*c* are approximately orthogonal to the upper surface 7 of the watch face 2, as illustrated in FIGS. 3A and 3B. In this case, the end portions 17*a* to 17*c* of the turning members 14*a* to 14*c* abut on the extension portions 10*a* to 10*c* in the vicinity of the base ends of the extension portions 10*a* to 10*c*, and therefore it is possible to easily raise the extension portions 10*a* to 10*c* such that the extension portions 10*a* to 10*c* are approximately orthogonal to the watch face 2. In addition, the configuration of the turning members 14*a* to 14*c* is simple where the turning members 14*a* to 14*c* turn about the turning shafts 15*a* to 15*c*, and therefore it possible to easily provide the turning member 14*a* to 14*c* for the extension portions 10*a* to 10*c*.

Here, as illustrated in FIG. 2, the turning members 14*a* to 14*c* are disposed in different positions in a direction along the watch face 2. To be more specific, the farther the turning members 14*a* to 14*c* are located from the watch face 2 in a direction orthogonal to the watch face 2, the closer the turning members 14*a* 14*c* are disposed to the rotation center L of the pointers 3*a* to 3*c*. By this means, the turning positions of the extension portions 10*a* to 10*c* are different in the direction along the watch face 2. Therefore, even though the extension portions 10*a* to 10*c* are turned to overlap with each other in the direction orthogonal to the watch face 2, it is possible to raise the extension portions 10*a* to 10*c* without touching each other.

Moreover, the extension portions 10*a* to 10*c* are moved to overlap with each other, and therefore it is possible to turn the extension portions 10*a* to 10*c* by the turning members 14*a* to 14*c* at a time. For example, an alignment switch is connected to the drive unit 13 and pushed to automatically rotate the pointers 3*a* to 3*c* to point the same position in the watch face 2, so that the extension portions 10*a* to 10*c* can be moved to overlap with each other. In this case, it is preferred that a raising member is stored in the watch body 1 to collectively raise the extension portions 10*a* to 10*c* which have been moved to overlap with each other. This raising member is stored in the edge of the watch face 2 to easily take the raising member out of the edge. Therefore, it is possible to easily raise the extension portions 10*a* to 10*c*. For example, the raising member may be formed in a hook shape, so that it is possible to pull up the extension portions 10*a* to 10*c* from below.

Here, it is preferred that the turning members 14*a* to 14*c* are spaced from each other at a distance which is approximately the same as the thickness of each of the extension portions 10*a* to 10*c* in the direction along the watch face 2. By this means, the turning members 14*a* to 14*c* are close to each other in the direction along the watch face 2, and therefore it is possible to reduce the size of the opening 12 of the watch face 2 depending on the arrangement of the turning members 14*a* to 14*c*.

Figure 4:
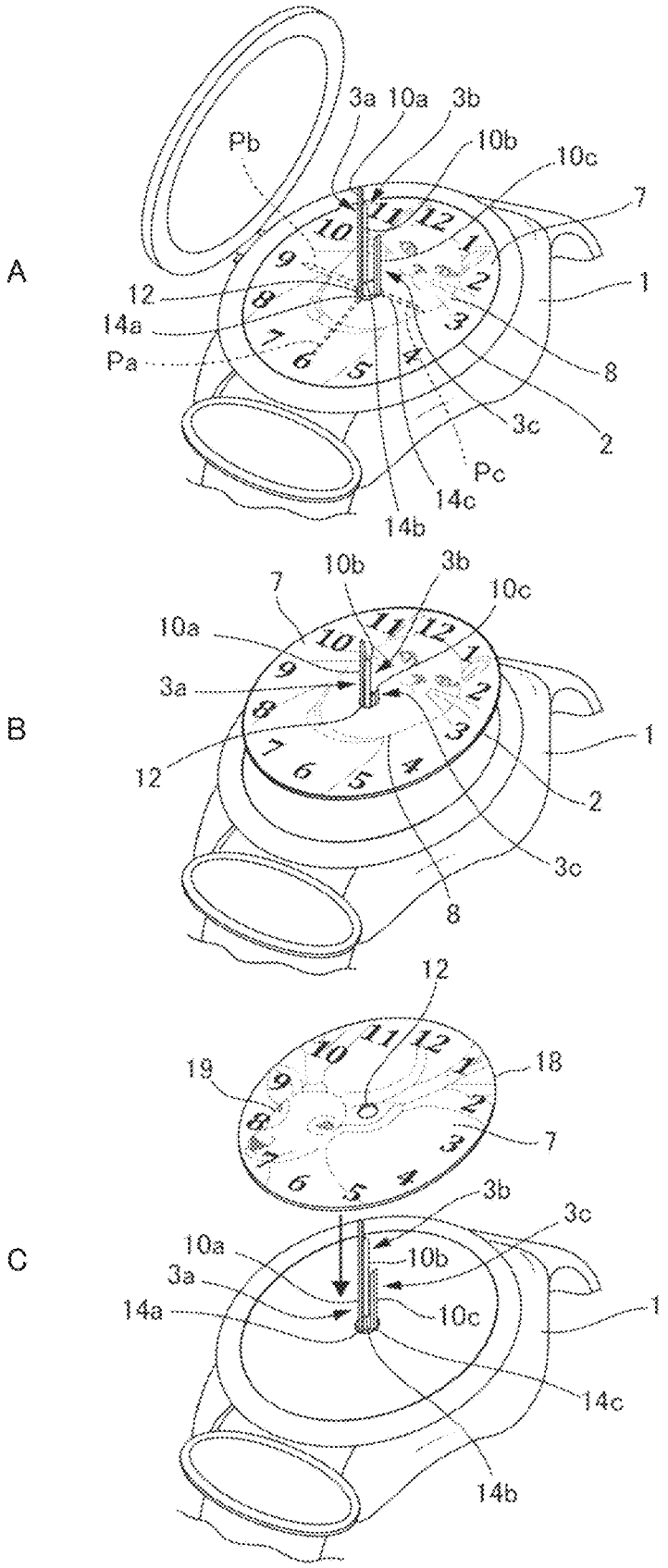
FIG. 4 illustrates a state where a watch face is replaced.

Moreover, it is preferred the turning members 14*a* to 14*c* turn the extension portions 10*a* to 10*c* around the opening 12 of the watch face 2 at different positions to change the postures of the pointers 3*a* to 3*c*. For example, as illustrated in FIG. 4A, the extension portions 10*a* to 10*c* are rotated around the opening 12 of the watch face 2 to move to positions Pa to Pc with an angle of 90 degrees from each other, and then the turning members 14*a* to 14*c* may turn the extension portions 10*a* to 10*c*. By this means, it is possible to smoothly raise the extension portions 10*a* to 10*c* without touching each other. Moreover, it is possible to prevent the extension portions 10*a* to 10*c* from touching each other, and therefore to dispose the turning members 14*a* to 14*c* at the same position in the direction along the watch face 2. Consequently, it is possible to further reduce the size of the opening 12 of the watch face 2. Here, it is preferred that the pointers 3*a* to 3*c* are automatically rotated to different positions around the opening 12 of the watch face 2 by pushing a movement switch (not shown). As described above, the pointers 3*a* to 3*c* are automatically moved, and therefore it is possible to easily raise the extension portions 10*a* to 10*c*.

In this way, the extension portions 10*a* to 10*c* are raised to be orthogonal to the upper surface 7 of the watch face 2, that is, raised not to face the upper surface 7. Therefore, it is possible to change the postures of the extension portions 10*a* to 10*c* to extend within the opening 12 in the opening direction of the opening 12. By this means, it is possible to smoothly move the watch face 2 along the extension portions 10*a* to 10*c* via the opening 12, and therefore to easily remove the watch face 2 from the watch body 1 without removing the pointers 3*a* to 3*c* from the watch body 1, as illustrated in FIG. 4B.

Next, as illustrated in FIG. 4C, the extension portions 10*a* to 10*c* are inserted into the opening 12 of a new watch face 18, so that it is possible to attach the watch face 18 to the watch body 1. In this way, it is possible to easily replace the watch face 2 with the watch face 18. For example, it is possible to replace the watch face 2 on which the decoration 8 is displayed with the watch face 18 on which a decoration 19 different from the decoration 8 is displayed. Conventionally, it is difficult to remove the watch face 2 from the watch body 1, and therefore it would be necessary to purchase a new watch to change the decoration 8 of the watch face 2. However, with the present embodiment, it is possible to easily change the watch face 2, and therefore to replace the decoration 8 with the decoration 19 only by replacing the watch face 2 with the watch face 18. In addition, the watch face 18 can display various types of the decoration 19, for example, which is designed by the owner or created by an artist. Moreover, the watch face 18 can display the decoration 19 corresponding to a song sung by a singer. For example, the watch face 18 may display the decoration 19 corresponding to the music inputted to an information input unit (not shown) of the watch body 1, or corresponding to the design of a music media such as a CD (compact disk).

In this way, the watch face 18 on which the decoration 19 is displayed is attached to the watch body 1, and then the extension portions 10*a* to 10*c* are turned by the turning members 14*a* to 14*c*, and returned in the original postures parallel to the watch face 18. At this time, the end portions 16*a* to 16*c* abut on the extension portions 10*a* to 10*c* in the vicinity of the base ends of the extension portions 10*a* to 10*c*, and therefore it is possible to make it easy to return the extension portions 10*a* to 10*c* in the original postures. Then, the stop switch (not shown) is released to drive the drive unit 13, so that the rotation of the pointers 3*a* to 3*c* is resumed at the right time.

With the present embodiment, the pointers 3*a* to 3*c* include the turning members 14*a* to 14*c* to change the postures of the extension portions 10*a* to 10*c* to be raised. Therefore, it is possible to remove the watch face 2 from the watch body 1 along the extension portions 10*a* to 10*c* raised by the turning members 14*a* to 14*c*. Accordingly, there is no need to unnecessarily change the shape of the watch face 2 to remove the watch face 2 from the watch body 1. Consequently, it is possible to easily remove the watch face 2 while maintaining the function of the watch face 2 such as the legibility of the time, and the design.

Embodiment 2

Figure 5:
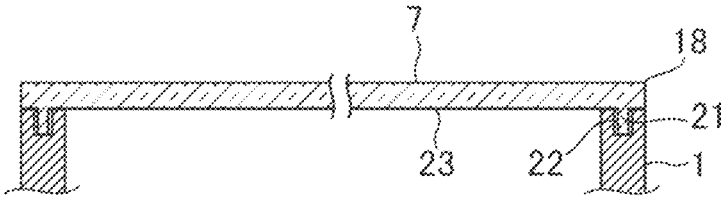
FIG. 5 illustrates the configuration of a watch face according to Embodiment 2.

With the above-described Embodiment 1, it is preferred that the watch face 2, 18 has a fixing portion to fix the watch face 2, 18 to the watch body 1. For example, as illustrated in FIG. 5, the watch face 18 according to Embodiment 1 may include fixing portions 21. Meanwhile, concave portions 22 corresponding to the fixing portions 21 are formed in the watch body 1. The two fixing portions 21 are formed to face one another in the vicinity of the edge of the watch face 18 and protrude from a lower surface 23 of the watch face 23.

Here, the fixing portions 21 are provided such that the time displayed on the watch face 18 is located at a predetermined position of the watch body 1 when the fixing portions 21 are fitted in the concave portions 22. Therefore, by fitting the fixing portions 21 in the concave portions 22, it is possible to align the watch face 18 with the watch body 1. With the present embodiment, the watch face 18 includes the fixing portions 21 to fix the watch face 18 to the watch body 1, and therefore it is possible to easily align the watch face 18 with the watch body 1.

Embodiment 3

Figure 6:
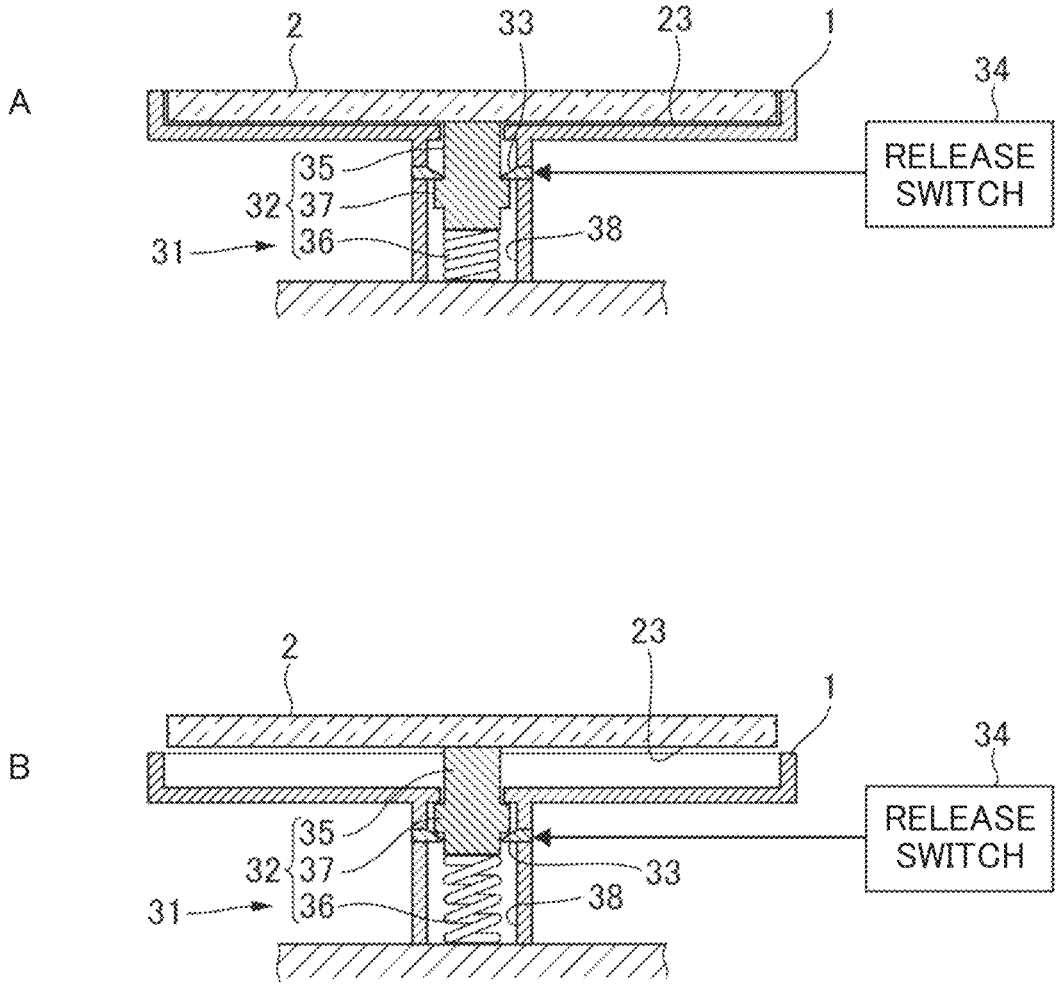
FIG. 6 illustrates a state where the watch face is removed from the watch body according to Embodiment 3.

With the above-described Embodiment 1 and 2, it is preferred that the watch body 1 includes an ejector to lift the watch face 2, 18 to separate from the watch body 1. For example, as illustrated in FIG. 6A, the watch body 1 according to Embodiment 1 may include an ejector 31. This ejector 31 includes a lift part 32, a lock part 33 and a release switch 34.

The lift part 32 is configured to lift the watch face 2 in a direction in which the watch face 2 separates from the watch body 1, and includes a lift body 35 and a biasing member 36. The lift body 35 has a pillar shape extending in the watch body 1 in a direction orthogonal to the watch face 2. The front end of the lift body 35 contacts the lower surface 23 of the watch face 2. The lift body 35 includes a protrusion 37 protruding from the side surface of the lift body 35. The lock part 33 engages with the upper surface of the protrusion 37 of the lift body 35 to lock the lift part 32. The lock part 33 protrudes from the side wall of the storage part 38 in which the lift body 35 is stored. In addition, the lock part 33 protruding from the side wall of the storage part 38 can retract into the storage part 38. When the lock part 33 retracts into the storage part 38, it is possible to release the lock on the lift part 32. The release switch 34 is connected to the lock part 33 to allow the lock part 33 to retract into the storage part 38.

In this way, the lift part 32 locked by the lock part 33 is stored in the storage part 38, and therefore does not lift the watch face 2. Accordingly, the watch body 2 remains to be attached to the watch body 1. Then, to remove the watch face 2 from the watch body 1, the release switch 34 is pushed to allow the lock part 33 to retract into the storage part 38. By this means, the lock on the lift body 35 by the lock part 33 is released. Then, as illustrated in FIG. 6B, the lift body 35 biased by the biasing member 36 is raised to separate the watch face 2 from the watch body 1. In this way, the watch face 2 is separated from the watch body 1, and therefore it is possible to smoothly insert the fingers between the watch face 2 and the watch body 1. By this means, it is possible to easily remove the watch face 2 from the watch body 1 along the extension portions 10*a* to 10*c* raised by the turning members 14*a* to 14*c*. Here, the lock part 33 is biased to protrude from the side wall of the storage part 38, and the protrusion 37 of the lift body 35 is moved from the front of the lock part 33, so that the lock part 33 is moved to protrude from the side wall of the storage part 38.

With the present embodiment, the watch body 1 includes the ejector 31 that lifts the watch face 2 to separate the watch face 2 from the watch body 1, and therefore it is possible to easily remove the watch face 2 from the watch body 1.

Embodiment 4

Figure 7:
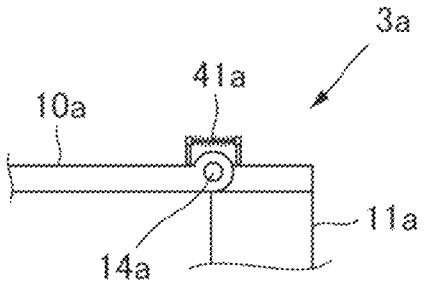
FIG. 7 illustrates the configuration of the turning member according to Embodiment 4.

With the above-described Embodiments 1 to 3, it is preferred that the turning members 14*a* to 14*c* include assisting parts to bias the extension portions 10*a* to 10*c* in the turning direction to assist the extension portions 10*a* to 10*c* to change their postures, respectively. For example, as illustrated in FIG. 7, the turning member 14*a* according to Embodiment 1 may have an assisting part 41*a*. This assisting part 41*a* is provided on the upper surface of the extension portion 10*a* to bias the extension portion 10*a* to the base end side to assist the extension portion 10*a* to be raised.

By this means, the extension portion 10*a* is biased by the assisting part 41*a*, and therefore it is possible to automatically raise the extension portion 10*a* by lightly touching the extension portion 10*a*, and therefore to easily change the posture of the extension portion 10*a*. Moreover, it is possible to reduce the pressure applied to the extension portion 10*a* when the extension portion 10*a* is raised, and therefore to prevent the extension portion 10*a* from deforming. Here, each of the turning members 14*b* and 14*c* includes an assisting part which is the same as that of the turning member 14*a*.

With the present embodiment, the turning members 14*a* to 14*c* include the assisting parts 41*a* to 41*c* that bias the extension portions 10*a* to 10*c* in the turning direction to assist the extension portions 10*a* to 10*c* to change their postures. Therefore, it is possible to easily change the postures of the extension portions 10*a* to 10*c*. Moreover, the extension portions 10*a* to 10*c* may be automatically turned by the turning members 14*a* to 14*c* without touching the extension portions 10*a* to 10*c* by the hand.

Embodiment 5

Figure 8:
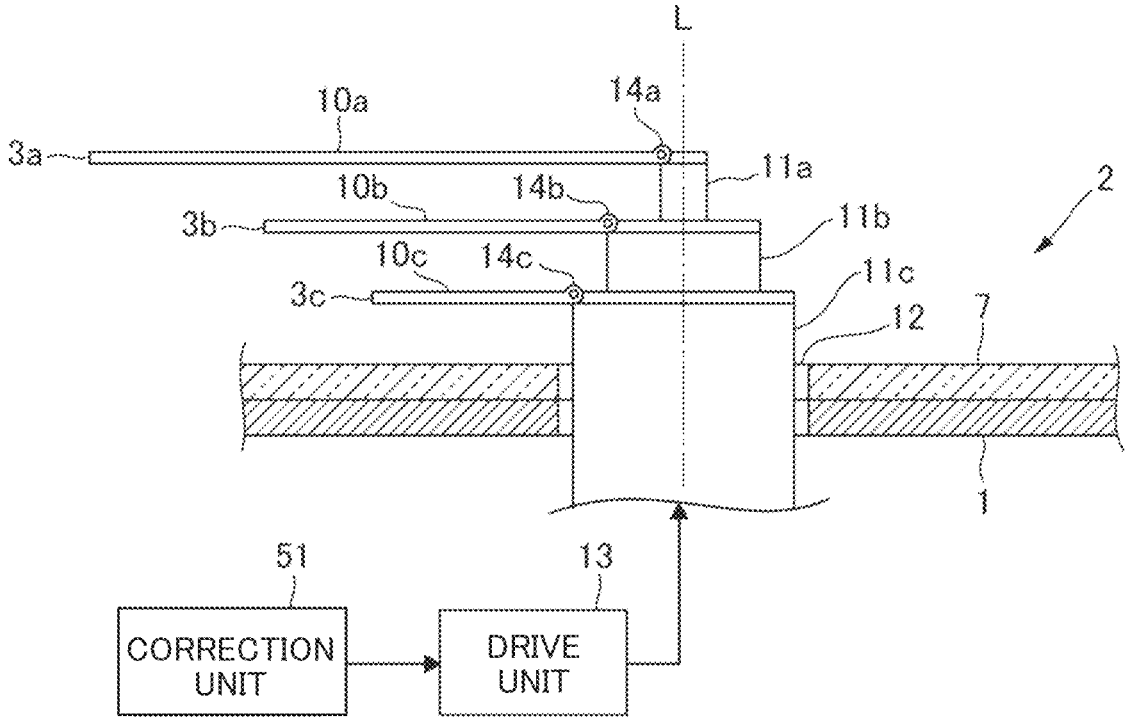
FIG. 8 illustrates the configuration of the watch body according to Embodiment 5.

With the above-described Embodiments 1 to 4, it is preferred that the watch body 1 includes a correction unit to correct the differences in the positions of the pointers 3*a* to 3*c*. For example, as illustrated in FIG. 8, the watch body 1 according to Embodiment 1 may include a correction unit 51 connected to the drive unit 13. This correction unit 51 includes a receiver that receives a standard time signal transmitted from a standard wave transmitting station. The correction unit 51 calculates the differences in the pointers 31 to 3*c* from the standard time, based on the standard time received by the receiver and the positions of the pointers 3*a* to 3*c*. The calculated differences are outputted from the correction unit 51 to the drive unit 13.

Then, the drive unit 13 corrects the positions of the pointers 3*a* to 3*c*, based on the differences inputted from the correction unit 51. By this means, even though the positions of the pointers 3*a* to 3*c* are different from the standard time due to, for example, the turning of the extension portions 10*a* to 10*c*, the correction unit 51 corrects the differences, and therefore the pointers 3*a* to 3*c* can indicate the correct time.

With the present embodiment, the watch body 1 includes the correction unit 51 to correct the differences in the positions of the pointers 31 to 3*c*, and therefore the pointers 3*a* to 3*c* can indicate the correct time.

With the above-described Embodiments 1 to 5, the extension portions 10*a* to 10*c* are formed to extend parallel to the upper surface 7 of the watch face 2 from the opening 12 to the edge of the watch face 2. However, the extension portions 10*a* to 10*c* may not necessarily extend parallel to the upper surface 7 of the watch face 2 as long as the extension portions 10*a* to 10*c* extend to face the upper surface 7 from the opening 12. For example, the extension portions 10*a* to 10*c* may be formed to extend at an angle with the upper surface 7 of the watch face 2.

In addition, with the above-described Embodiments 1 to 5, the turning members 14*a* to 14*c* turn the extension portions 10*a* to 10*c* in the direction approximately orthogonal to the watch face 2. However, this is by no means limiting as long as the turning members 14*a* to 14*c* turn the extension portions 10*a* to 10*c* to be raised. Moreover, with the above-described Embodiments 1 to 5, the turning members 14*a* to 14*c* turn the extension portions 10*a* to 10*c* for the same angle with respect to the watch face 2. However, this is by no means limiting as long as the turning members 14*a* to 14*c* turn the extension portions 10*a* to 10*c* to be raised. For example, the turning members 14*a* to 14*c* can change the angle of the turning of the extension portions 10*a* to 10*c* depending on the lengths of the extension portions 10*a* to 10*c*. That is, the extension portion 10*a* longer than the extension portion 10*b* is turned for an angle greater than that of the extension portion 10*b*. By this means, it is possible to arrange the extension portions 10*a* to 10*c* at the same distance from the center of the opening 12 when the extension portions 10*a* to 10*c* are raised, and therefore to reduce the size of the opening 12 of the watch face 2.

Figure 9:
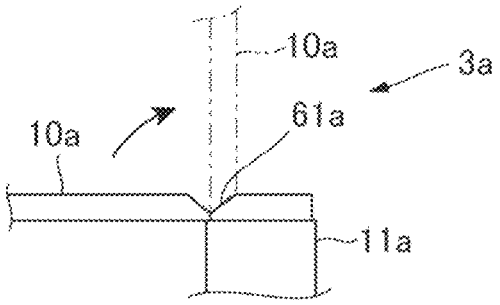
FIG. 9 illustrates the configuration of the change portion according to a modification of Embodiments 1 to 5.

Moreover, with the above-described Embodiments 1 to 5, the turning members 14*a* to 14*c* turn the extension portions 10*a* to 10*c* to be raised. However, this is by no means limiting as long as it is possible to change the postures of the extension portions 10*a* to 10*c* to be raised. For example, as illustrated in FIG. 9, a change portion 61*a* may be provided instead of the turning member 14*a* according to Embodiment 1. This change portion 61*a* is formed as a concave portion on the upper surface of the extension portion 10*a* to fold the extension portion 10*a* to be raised in order to change the posture of the extension portion 10*a*. Here, in order to form this change portion, the extension portions 10*a* to 10*c* may be made of a flexible material, and therefore it is possible to fold the extension portions 10*a* to 10*c* to be raised, and consequently to change the postures of the extension portions 10*a* to 10*c*. In this case, it is preferred that the change portions are made of a shape-memory material.

Moreover, with the above-described Embodiments 1 to 5, the watch face 2, 18 may be made of an elastic material, such as rubber and silicone. Likewise, the time and the decoration displayed on the watch face 2, 18 may be made of an elastic material. By this means, it is possible to deform the opening 12 of the watch face 12, 18. Even when the size of the opening 12 is reduced, it is possible to smoothly move the watch face 2, 18 along the extension portions 10*a* to 10*c*. For example, when the turning members 14*a* to 14*c* are disposed outside the opening 12 in the direction along the watch face 2, that is, when a circumference formed by the front ends of the extension portions 10*a* to 10*c* raised by the turning members 14*a* to 14*c* is greater than the opening 12, it is possible to remove the watch face 2 along the extension portions 10*a* to 10*c* by deforming the opening 12.

Furthermore, with the above-described Embodiments 1 to 5, it is possible to stereoscopically display the time and the decoration on the watch face 12, 18. For example, the decoration 8 of the watch face 2 may be popped up when the protection member 4 opens. Alternatively, the decoration 8 of the watch face 2 may be formed to move in three dimensions. Furthermore, with the above-described Embodiments 1 to 5, the watch face 2, 18 has a discoid shape. However, this is by no means limiting as long as the watch face 2, 18 has the opening 12.

Furthermore, with the above-described Embodiments 1 to 5, the pointers 3*a* to 3*c* are rotated according to the time. However, this is by no means limiting as long as the pointers 3*a* to 3*c* extend to face the upper surface 7 of the watch face 2. For example, when the decoration 8 is moved on the watch face 2, the pointers 3*a* to 3*c* may be rotated depending on the motion of the decoration 8. Alternatively, the pointers 3*a* to 3*c* may be rotated counterclockwise with respect to the time displayed on the watch face 2.

Furthermore, with the above-described Embodiments 1 to 5, the watch has the three pointers 3*a* to 3*c*. However, this is by no means limiting, and the watch may have one pointer. Furthermore, with the above-described Embodiments 1 to 5, the watch is a wristwatch. However, this is by no means limiting as long as the pointers 3*a* to 3*c* are arranged to sandwich the watch face 2 between the pointers 3*a* to 3*c* and the watch body 1. For example, the present invention is applicable to, for example, a wall clock, a table clock, a pocket watch, and an alarm clock.

REFERENCE SIGNS LIST

1 watch body
2, 18 watch face
3*a* to 3*c* pointer
4 protection member
5 display
6 belt
7 upper surface
8, 19 decoration
9 open and close member
10*a* to 10*c* extension portion
11*a* to 11*c* support portion
12 opening
13 drive unit
14*a* to 14*c* turning member
15*a* turning shaft
16*a*, 17*a* end portion
21 fixing portion
22 concave portion
23 lower surface
31 ejector
32 lift part
33 lock part
34 release switch
35 lift body
36 biasing member
37 protrusion
38 storage part
41*a* assisting part
51 correction unit
61*a* change portion
L rotation center
Pa to Pc position

The invention claimed is:

1. A watch comprising:
a watch body;
a watch face attached to the watch body and having an opening; and
a pointer including:
an extension portion disposed to sandwich the watch face between the extension portion and the watch body and extending from the opening to face an upper surface of the watch face; and
a support portion protruding from the watch body into the upper surface of the watch face via the opening, and connected directly to the extension portion,
wherein the pointer includes a change portion formed in the extension portion to change a posture of the extension portion such that a front end of the extension portion is raised with respect to a base end of the extension portion to be apart from the watch face, and
the watch face is removed from the watch body along the extension portion raised by the change portion.

2. The watch according to claim 1, wherein the change portion includes a turning member to turn the extension portion to be raised.

3. The watch according to claim 1, wherein the change portion changes the posture of the extension portion to be orthogonal to the watch face.

4. The watch according to claim 1, further comprising:

a plurality of pointers each including the extension portion having the change portion, wherein the change portion changes postures of extension portions of the plurality of pointers around the opening at different positions.

5. The watch according to claim 1, wherein the watch face includes a fixing portion to fix the watch face to the watch body.

6. The watch according to claim 1, wherein the watch body includes an ejector configured to lift the watch face to separate the watch face from the watch body.

7. A watch face attached to the watch according to claim 1.

* * * * *